US007357768B2

(12) United States Patent
Marshall

(10) Patent No.: US 7,357,768 B2
(45) Date of Patent: Apr. 15, 2008

(54) RECLINER EXERCISER

(76) Inventor: William Marshall, 1050 Givens-Tyler Rd., Salem, VA (US) 24153

( * ) Notice: Subject to any disclaimer, the term of this patent is extended or adjusted under 35 U.S.C. 154(b) by 33 days.

(21) Appl. No.: 11/234,651

(22) Filed: Sep. 22, 2005

(65) Prior Publication Data

US 2007/0066452 A1 Mar. 22, 2007

(51) Int. Cl.
*A63B 26/00* (2006.01)
*A63B 71/00* (2006.01)

(52) U.S. Cl. ..... 482/148; 482/142

(58) Field of Classification Search ..... 482/142, 482/148

See application file for complete search history.

(56) References Cited

U.S. PATENT DOCUMENTS 3,738,649 A * 6/1973 Miller ..... 482/57
3,968,963 A * 7/1976 Sileo ..... 482/57
4,422,635 A * 12/1983 Herod et al. ..... 482/80
D289,190 S * 4/1987 Brentham ..... D21/676
4,776,583 A * 10/1988 Jennings ..... 482/63
4,805,901 A * 2/1989 Kulick ..... 482/63
4,913,423 A * 4/1990 Farran et al. ..... 482/130
4,921,247 A * 5/1990 Sterling ..... 482/138
5,002,271 A * 3/1991 Gonzales ..... 482/130
5,098,158 A * 3/1992 Palarski ..... 297/330
D340,269 S * 10/1993 Stevens ..... D21/666
5,470,298 A * 11/1995 Curtis ..... 482/130
5,486,148 A * 1/1996 Johnston ..... 482/57
6,368,260 B1 * 4/2002 Crews ..... 482/142
7,083,235 B2 * 8/2006 Grimm et al. ..... 297/423.21
7,094,188 B2 * 8/2006 Reitz et al. ..... 482/142
7,195,583 B2 * 3/2007 Leib ..... 482/52

* cited by examiner

*Primary Examiner*—Lori Amerson
(74) *Attorney, Agent, or Firm*—James W. Hiney

(57) ABSTRACT

A recliner exerciser for simulating walking in which the user can adjust the degree on reclining as well as the amount of simulated walking and exercise his or her legs are subjected. A motorized gear box operates two moveable foot rests in varying degrees of incline to provide minor to aggressive walking simulation for the user.

13 Claims, 9 Drawing Sheets

RECLINER EXERCISER

The instant invention relates to a motorized recliner which is used to both support the body in a reclining position for relaxation and to exercise the legs of the user to simulate walking when the user has an affliction which prevents actually walking such as temporary inability caused by surgery or a major problem such as arthritis, gout or other malady.

BACKGROUND OF THE INVENTION

Among the problems facing those people who have contracted arthritis or have other debilitating ailment, such as diabetes, which prevents them walking is the impact on their joints when they attempt to walk with the help of a walker or cane. In short, a lot of these people cannot walk at all. Such a condition prevents them from getting the exercise their legs need to prevent arterial disease or deterioration of the joints.

BACKGROUND PRIOR ART

Various attempts have been made to provide an exercise chair but none of the prior art anticipate or perform the same functions as the instant invention. The patent to Stevens (Des. 340,269) shows a chair with foot portions that evidently move up and down but there does not appear to be a reclining feature to adjust the degree of aggressiveness of the exercise feature. Brenthan (Des. 289,190) appears to show foot portions of a chair which are movable but one of them appears to be a lifting section with two rollers which is used to strengthen leg muscles and the chair does not recline.

The reclining exercise chair of Studdard (U.S. 2003/0087737) is a chair that can be put in various positions for exercising and which has various pulleys, braces, and adjustable features but is not motorized and could not perform the functions of the instant invention. Herod (U.S. Pat. No. 4,422,635) shows a pair sprung foot portions used to exercise that are not connected to a chair or recliner.

U.S. Pat. No. 6,368,260 to Crews shows a static chair where static exercises may be performed but the chair is not motorized and does not have the features to accomplish the function of the instant invention. Sterling (U.S. Pat. No. 4,921,247) shows a chair having means to exercise the arms and a pedal assembly for the feet. It is similar to Curtis (U.S. Pat. No. 5,470,298) which shows a chair with arm exercisors and a pedal assembly for the feet. Likewise the patents to Silco (U.S. Pat. No. 3,968,963) and Miller (U.S. Pat. No. 3,738,649) show the same features but none of them can perform the function of the instant invention.

SUMMARY OF THE INVENTION

The present invention provides a solution to the problem facing people who cannot walk but must to preserve joint integrity and prevent circulatory diseases. It is in the form of a chair recliner which allows a user to either sit up or recline. The recliner is motorized and has leg portions which move in a swinging motion to and from the recliner. When the recliner is in the sitting position, the movement to and from the recliner is limited from the knee down with only the knee engaged. As the recliner is progressively reclined, the amount of movement and the angle of movement increases and the hip, knee and ankle are engaged. As the amount of movement increases the distance between the hip, knee and ankle is shortened thereby causing the knee to be bend outward and upward off the edge of the chair recliner. This also rotates the hip and ankle to a greater degree. There are two foot rests which alternate moving to thereby simulate the exercise of actually walking. The chair recliner has controls which allow the user to adjust the degree of reclining and the amount of movement so that the entire exercise is comfortable to them. Upon shutting the chair recliner off it resumes its initial position with the foot rests parallel.

With a normal setting the recliner affords a simulated walking pace of about 12 steps per minute. The center foot rest portion has a couple of rotating portions fixed underneath which, through the action of eccentrics, rotate the other two foot rest portions that the feet are set upon. If one merely lays their foot across the two outermost foot rest portions, the recliner acts as a leg lifter without the walking function. This may be more desirable to a user depending on the condition of his or her legs.

OBJECTS OF THE INVENTION

It is therefore an object of the invention to provide an exerciser recliner chair to simulate walking for a user who cannot put stress or weight upon his or her legs, and A further object of the invention is to provide a walking simulating exerciser one can use in either an upright sitting position or a reclining position, and A still further object of the invention is to provide a walking simulating exerciser where the amount of recline and speed of the walking simulation is adjustable by the user, and Yet another object of the invention is to provide a walking simulating exerciser where the user may rest one of his or her legs while exercising the other one simultaneously, and These and other objects of the invention will become apparent when reference is had to the accompanying drawings in which FIG. 1 is front view of the recliner.

Figure 16:
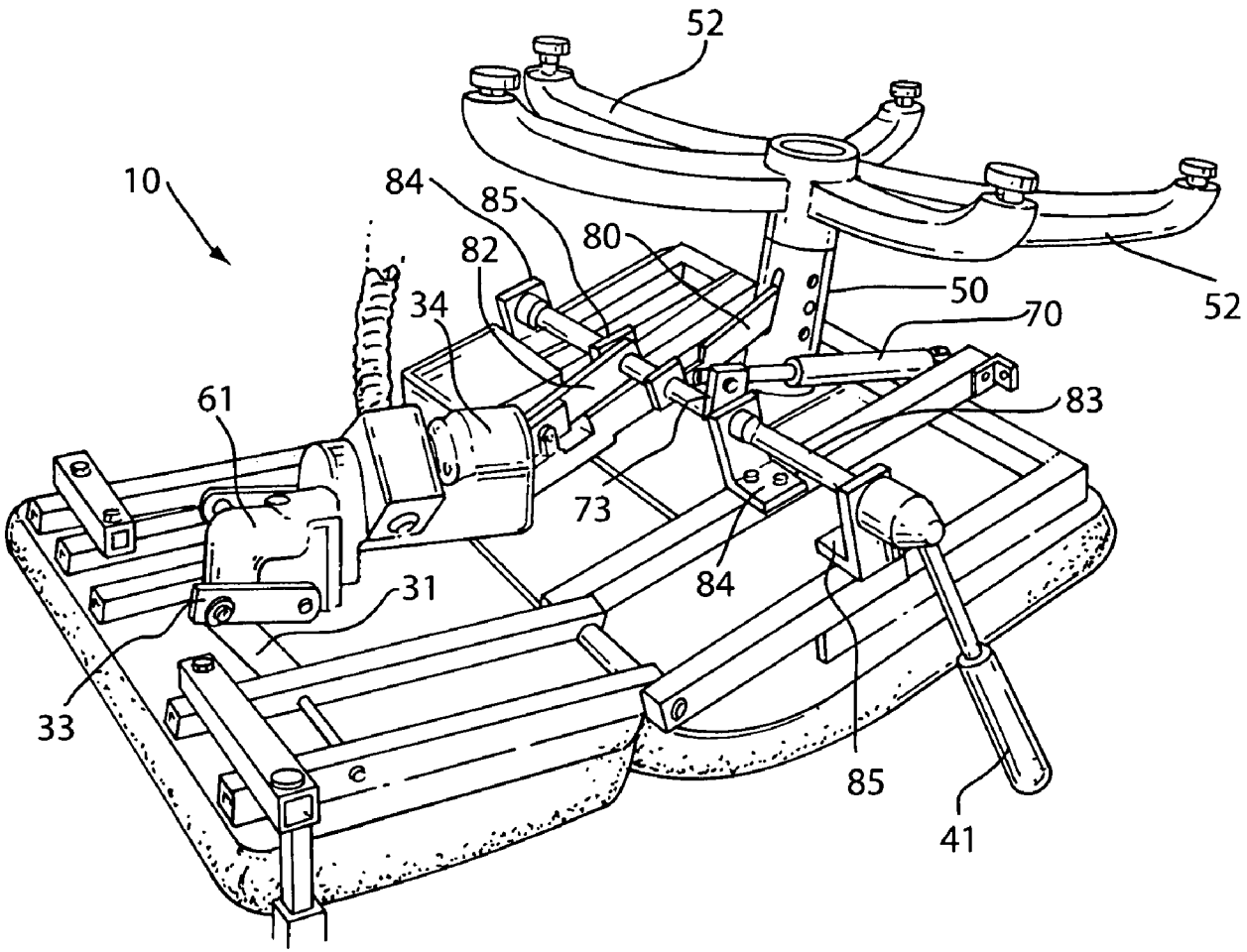
FIG. 16 is perspective view of the underside of the invention showing the various components.
Figure 17B:
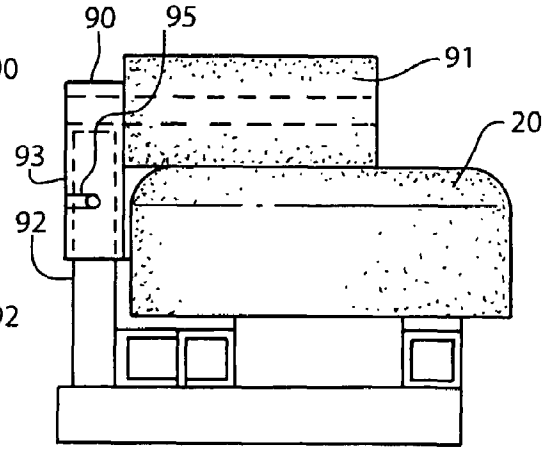
FIGS. 17*a* and 17*b* are side and end views of the foot rail assembly.
Figure 17A:
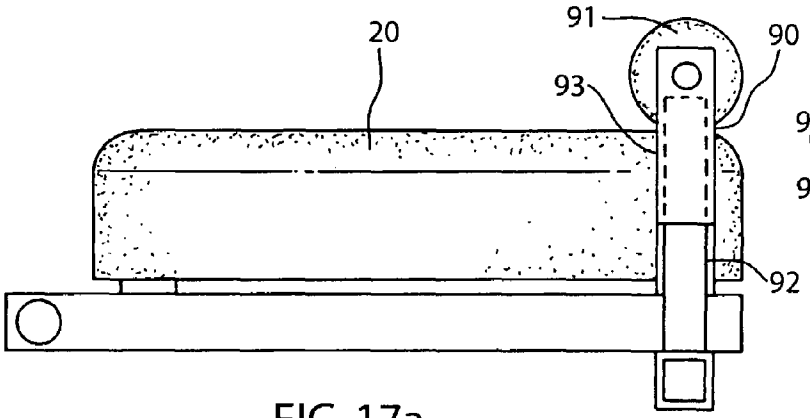
Figure 18B:
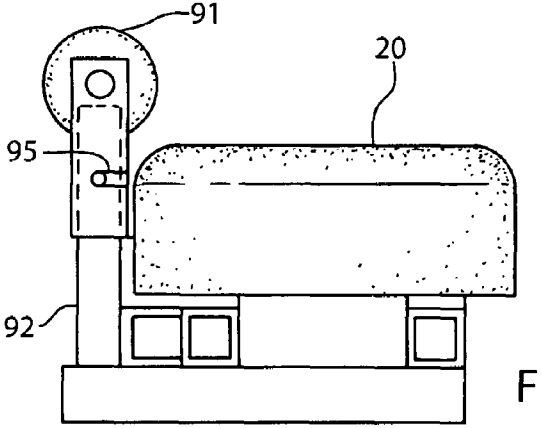
Figure 18A:
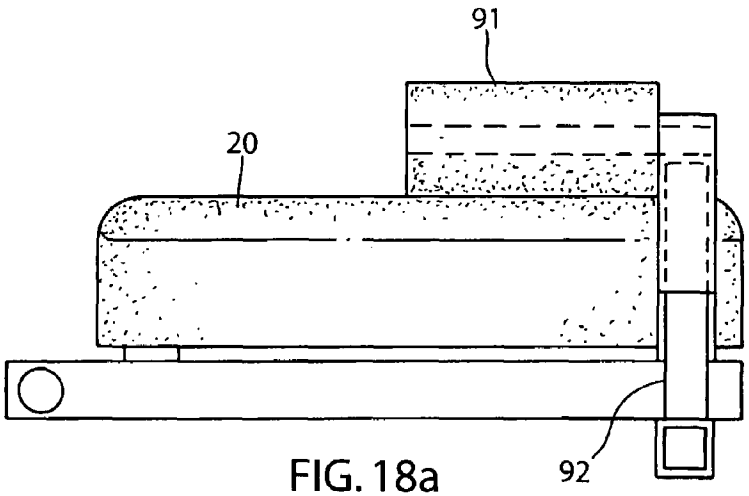
Figure 19:
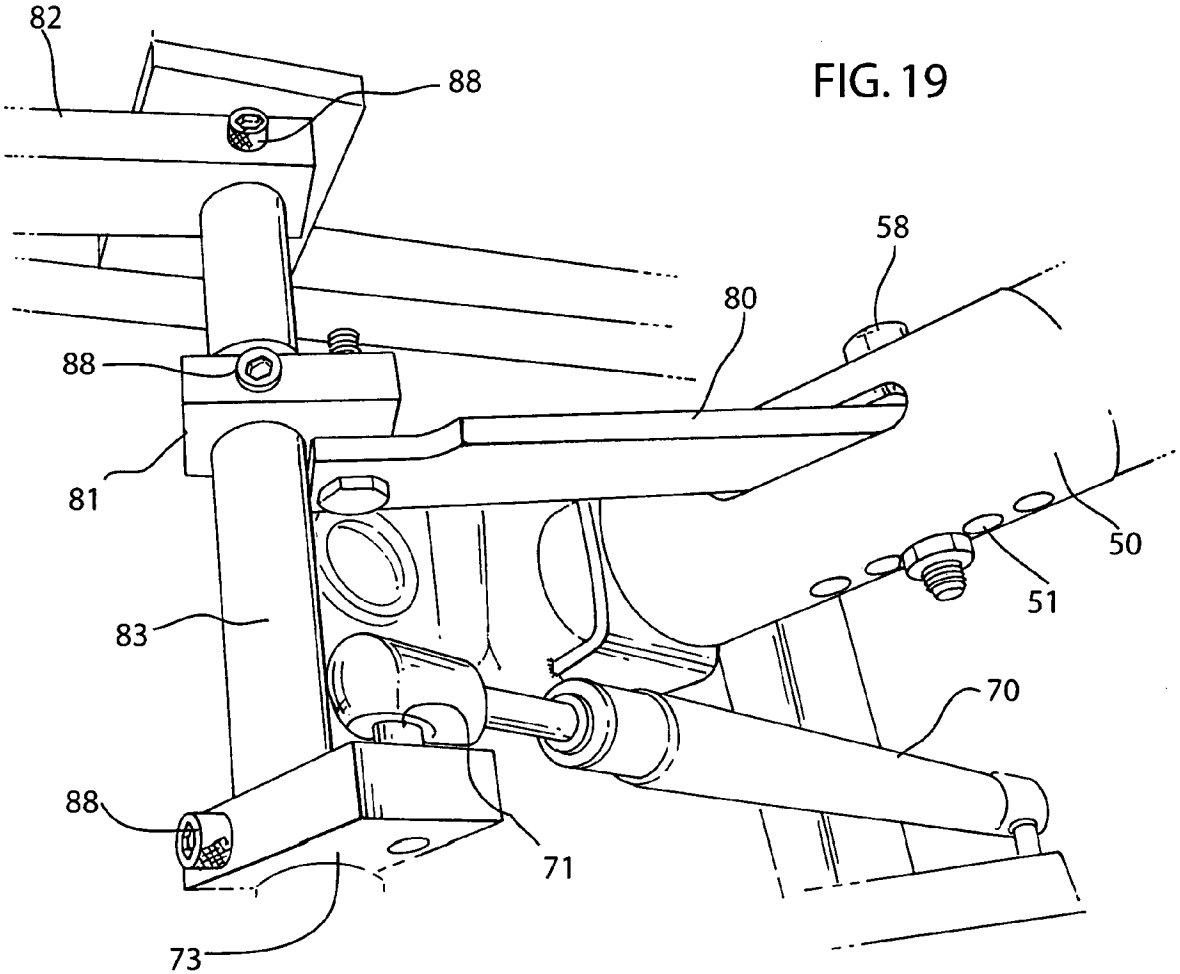

FIGS. 18*a* and 18*b* are side and end views of the foot rail assembly showing the heel rest rotated out of the way while the user is resting and FIG. 19 is a perspective view of a portion of the view of FIG. 16 showing the recline tilt bar and the gas spring and their relationship to the recline shaft.

DETAILED DESCRIPTION OF THE INVENTION

Figure 1:
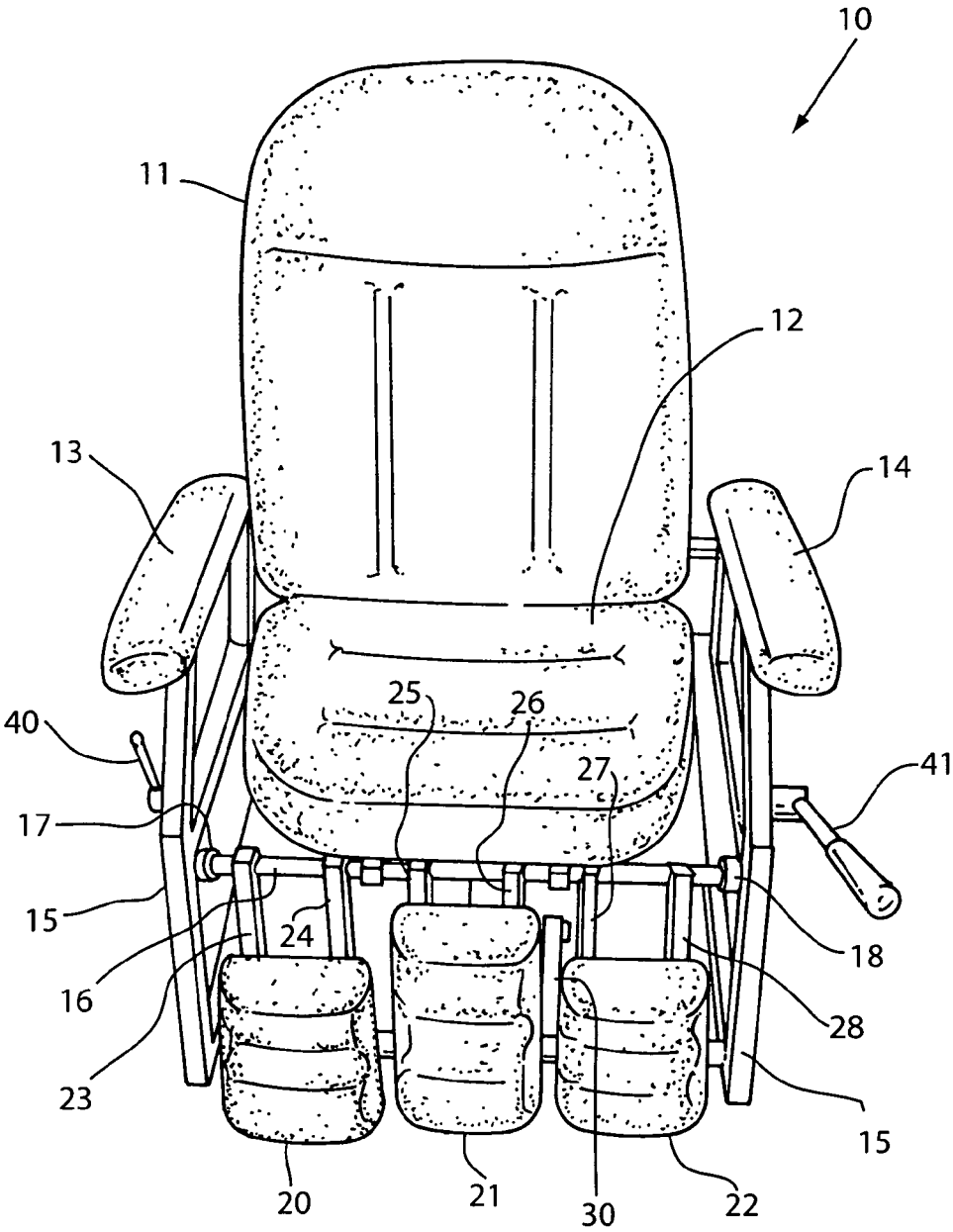

Referring now to FIG. 1 there is show the recliner 10 having a back support section 11, a seat portion 12, arm rests 13 and 14, and a support frame 15. Frame 15 supports a rotating recline shaft 16 which is journaled into the frame at 17 and 18 In front of the recliner are right foot rest 20, center foot rest 21 and left foot rest 22. The foot rests are respectively secured to the shaft 16 by rails 23 and 24, 25 and 26, and 27 and 28. Showing in FIG. 1 is motor cam bar 30. Also shown are recline lock 40 and recline lever 41.

Figure 2:
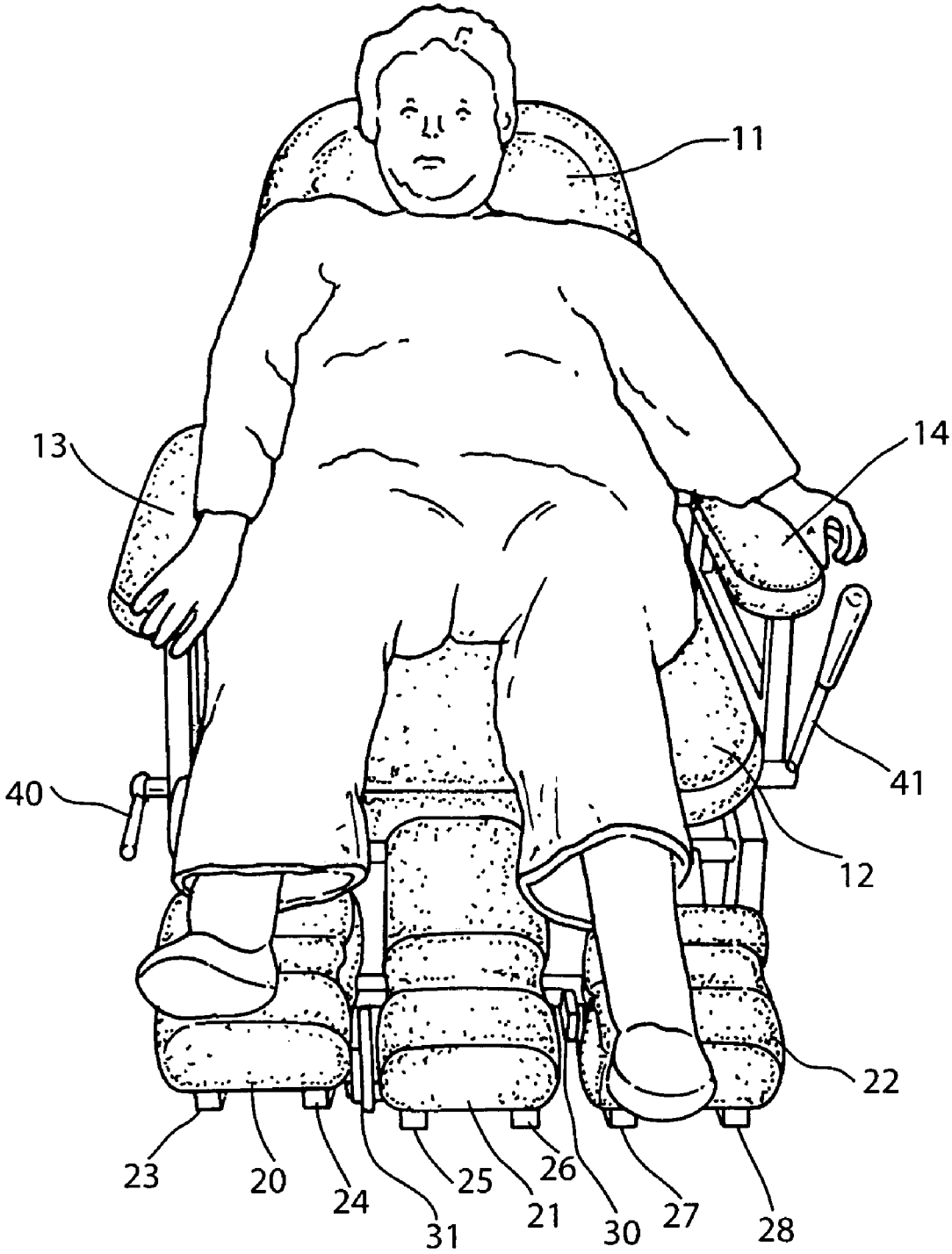
FIG. 2 is a front view of the recliner with a user thereon and moving.
Figures 3, 4:
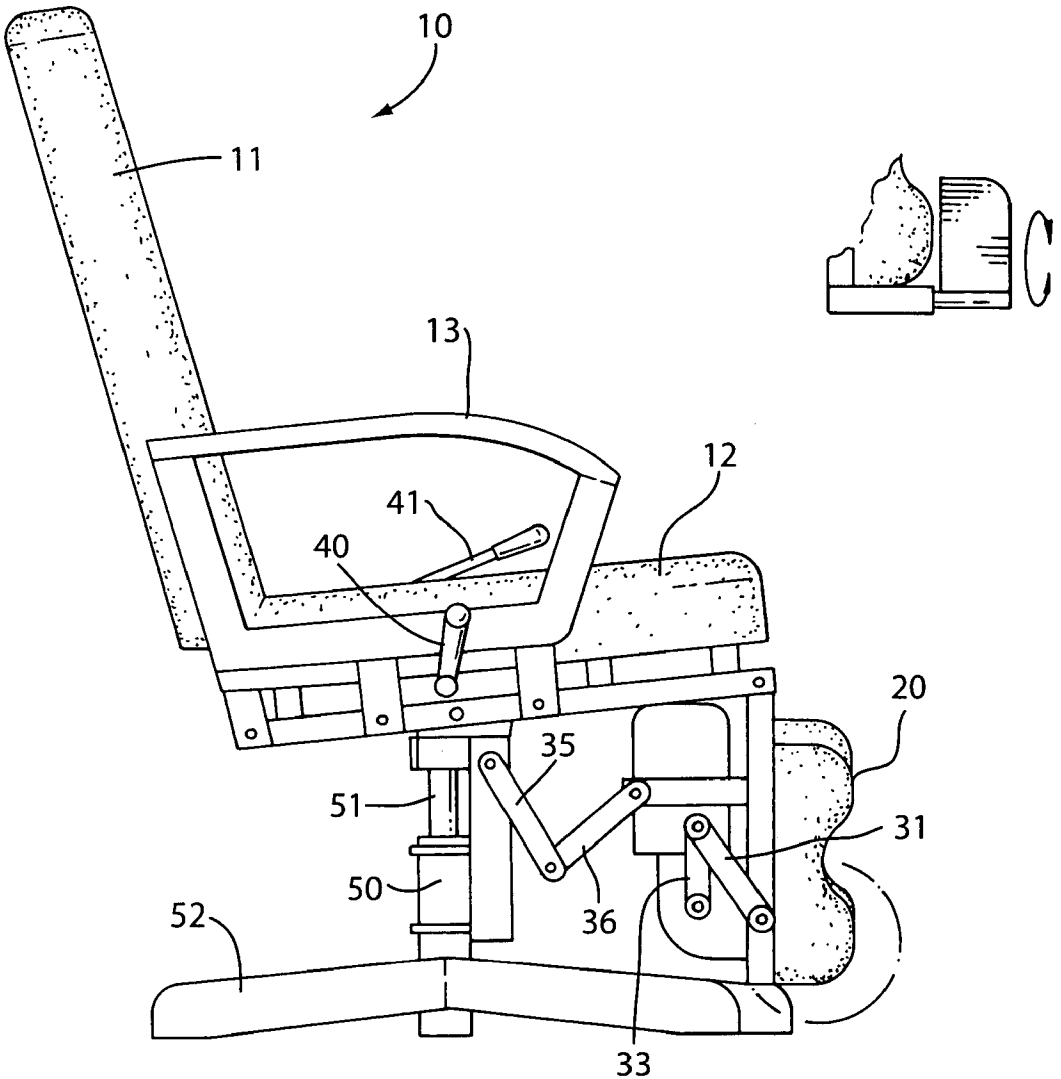
FIG. 3 is a partial view of the foot rest.
FIG. 4 is a side view of the recliner showing the mechanisms underneath and in normal position which minimizes leg movement.

FIG. 2 shows a user in the recliner with her feet upon the left and right,foot rests. Both motor cam bar 30 and 31 are shown operating the foot rests in this figure. The figure shows the recliner in the recline position with the foot elevated and the knees cocked. FIG. 3 shows a partial view of the rotated heel rest shown in more detail later herein.

Figure 5:
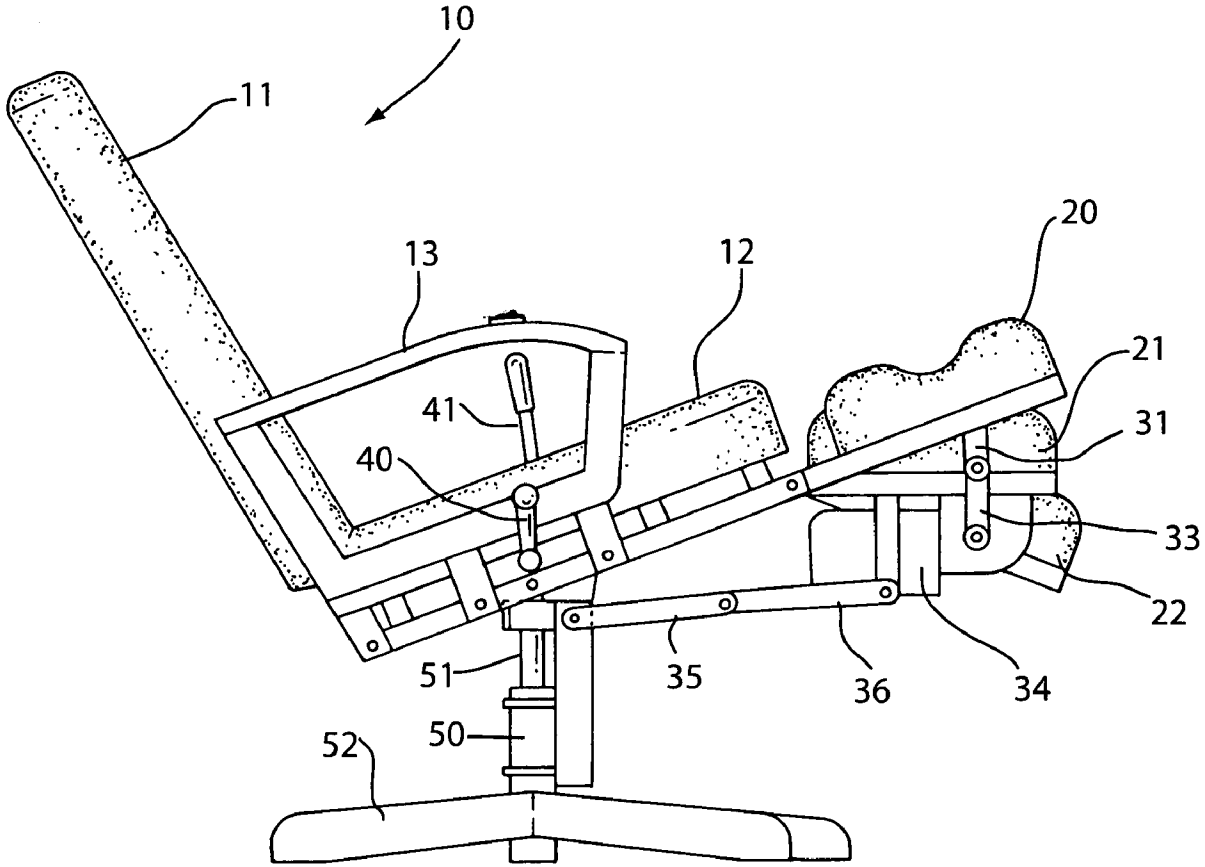
FIG. 5 is side view of the recliner showing the mechanism extended and the foot rests in their aggressive position to afford the most leg movement.
Figure 6:
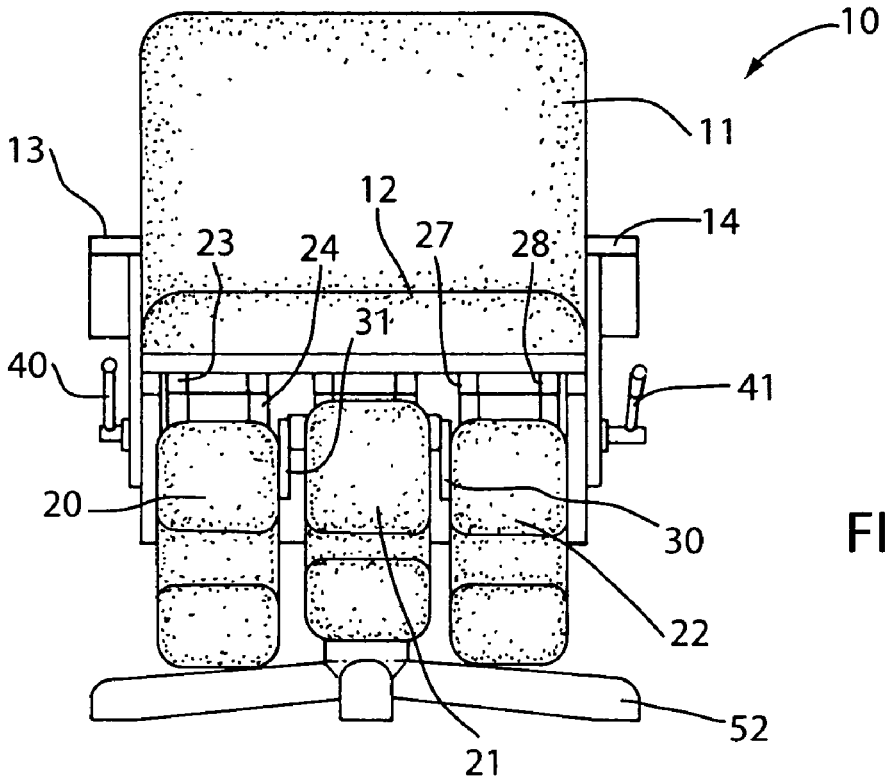
FIG. 6 is a front view of the recliner showing the normal position as in FIG. 4.
Figure 7:
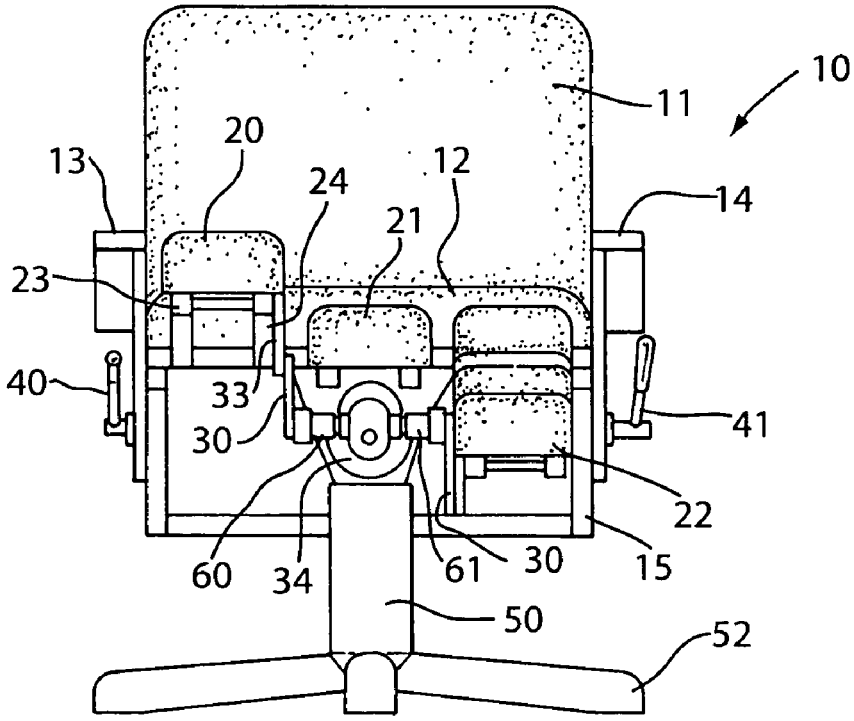
FIG. 7 is a front view of the recliner showing the aggressive position as in FIG. 5.

FIG. 4 shows the recliner 10 with pedestal 50 and adjustment holes and bolt 51 to adjust the height thereof as well as support member 52 to hold the pedestal 50. It shows motor cam bar 31 which is connected to eccentric rod 33 and which is driven by geared motor 34. Also shown are foot lift bars 35 and 36 which are adapted, when gear motor 34 is engaged, to straighten out the bars so that the foot rests are extended in the recline position as shown in FIG. 5. When so extended the bars 31 and 30 are also extended FIGS. 6 and 7 show the front of the recliner 10 with the foot rests down (FIG. 6) and up (FIG. 7). FIG. 7 shows the gear motor 34 engaging shafts which drive eccentrics such as 30 and 31 to raise and lower foot rests 20 and 22 alternately so as to mimic the act of walking. FIG. 7 shows the motor cam arms 60 and 61 used to drive the bars and which are referred to as eccentrics. Again, a user may use lever 41 to adjust the amount of recline and lock it with lever 40 so as to insure that the chair recliner is comfortable and suits their particular needs. It should be noted that the chair recliner can be made in various sizes so as to accommodate people from short and slight build up to tall and heavy and sizes in between. The length of the eccentric bars can be adjusted so as to accommodate someone with long legs with a normal sized upper body.

Figure 8:
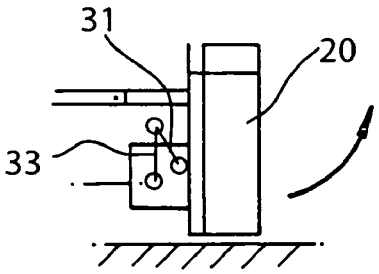
FIG. 8 shows a partial side view of the upright position with the foot rest down.
Figure 12:
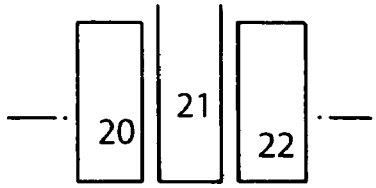
FIG. 12 shows a partial front view in the upright position with the foot rests down.
Figure 9:
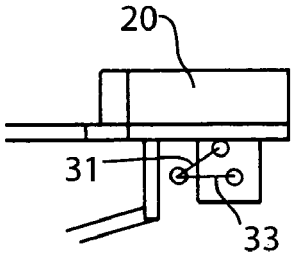
FIG. 9 shows a partial side view of the recline position with the foot rest up.
Figure 13:
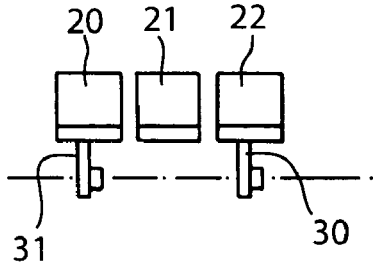
FIG. 13 shows a partial front view in the recline position with the foot rests up.
Figure 10:
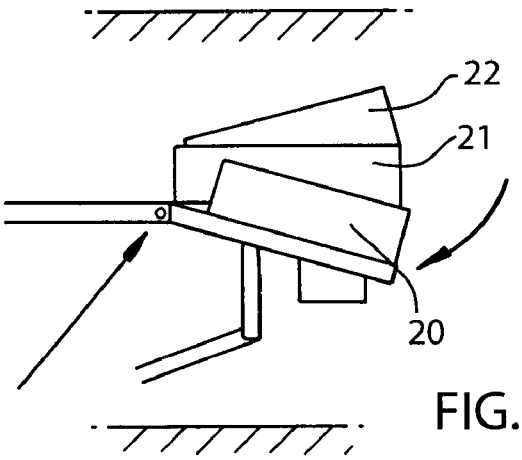
FIG. 10 shows a partial side view in motion in the recline position with the left foot rest up and the right foot rest down.
Figure 14:
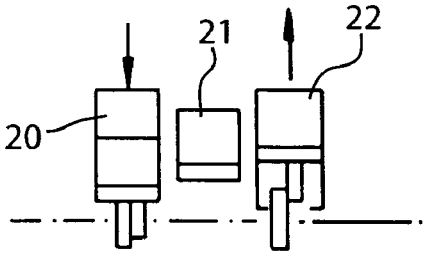
FIG. 14 shows a partial front view in the recline position while in motion with the left foot rest up and the right foot rest down.
Figure 11:
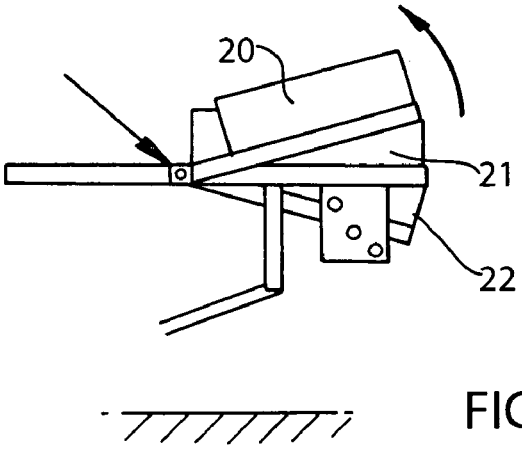
FIG. 11 shows a partial side view in motion in the recline position with the right foot Rest up and the left foot rest down.
Figure 15:
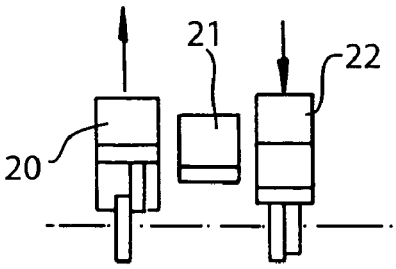
FIG. 15 shows a partial front view in the recline position while in motion with the right foot rest up and the left foot rest down.

FIGS. 8 through 15 show the side and end views of the foot supports as the recliner is moved through various positions. FIGS. 8 and 12 show the foot supports in a vertical position, FIGS. 9 and 13 show it in a raised position. FIGS. 10 and 14 show the side and end views of the foot supports when the recliner is moving in an outward position to exercise the lower legs. Likewise, FIGS. 11 and 15 show the foot supports moving in an inward position. FIGS. 17*a*, 17*b*, 18*a* and 18*b* show the foot supports with a heel rest 90 consisting of a roller portion 91 rotatably attached to the upper bracket member 93 which is adjustably mounted upon square member 92. The distance of the portion 91 from 20 can be adjusted by a bolt and holes such as shown at When not using the roller foot support 91 it can be moved to the side as shown in FIGS. 18*a* and 18*b*. The foot support is simply detached by loosening the bolt, rotated 90 degrees and then re-attached as shown so that it will still be attached but out of the way.

FIG. 19 shows the details of the underside of a second embodiment of the recliner. A recline tilt bar 80 is pivotally attached as at bolt 51 to the chair pedestal 50 and attached, at its other end, to recline tilt cam 81 which is clamped upon bar 83 which rotates in bearing blocks such as 84 and 85 and to which is clamped foot lift bar 82. A gas spring 70 is pivotally attached at one end to the underside of the chair and attached, via pivot 71 to gas spring lever, 73, which, in turn, is clamped on bar 83 which is adapted to rotate to tilt the chair when the user engages lever 41. The degree of tilt can be adjusted by moving bolt 58 in holes such as 51. Bolts such as 88 secure the various cams to rotating bar 83 to facilitate movement. In FIG. 19 the recline tilt cam is in the horizontal position and the recline tilt bar has moved backward moving the pedestal from the upright to the recline position.

Having described the preferred embodiment of the invention it will be obvious to those of ordinary skill in the art to make changes without departing from the scope of the appended claims.

What is claimed is:

1. A recliner exerciser which allows a user who cannot walk to simulate the walking function without any impact on the legs of the user, said exerciser comprising, a chair means to support a user in a sitting position, a movable front portion of said chair means designed to abut the lower legs of said user, user adjustable means to recline the chair to a preselected angle, a pair of justaposed foot rests on said movable front portion which allow for alternate forward and back movement of the feet and lower legs relative to the chair means, a power gear box with offset eccentrics connected to said foot rests to alternately move them forward and backward relative to said chair means to thereby simulate walking for the user.

2. A recliner as in claim 1 wherein said chair means also includes a recliner lever whereby the user can adjust the angle of recline.

3. A recliner as in claim 2 also including a lock for locking the recliner lever in a set position.

4. A recliner as in claim 1 wherein said front portion has three sections, a movable left section for one foot rest, a movable right section for said second foot rest and a center section that is not movable.

5. A recliner as in claim 1 wherein said chair means has an adjustable support whereby the height of the chair means may be adjusted.

6. A recliner as in claim 4 wherein said foot rests are covered with soft material.

7. A recliner as in claim 4 wherein the means for powering the movable foot rests is a gearbox attached to the underside of said center section.

8. A recliner as in claim 4 wherein the center section is parallel with the horizonwhen the chair is adjusted for maximum aggressive movement of the legs.

9. An exercise recliner which can be moved from a sitting position to a horizontal reclining position to afford stimulation of the legs by simulating the act of walking, said recliner comprising a chair portion have a back support, a seat portion and two arm supports, a front portion hinged to said chair portion to allow for pivotal movement away from said chair portion from a vertical to a horizontal position, said front portion having at least two foot rest sections which are movable relative to one another, a motor connected to said foot rest sections to move them in an alternate manner so as to simulate the act of walking and to exercise the user's legs, and wherein said front portion also includes a center section which is not movable relative to the other two foot rest sections and under which said motor is attached.

10. An exerciser as in claim 9 wherein said motor is a gearbox motor with eccentric links to said foot rest sections to afford alternate movement thereto.

11. An exerciser as in claim 10 wherein the front section is adjustable by the userby means of an adjustment reclining lever.

12. An exerciser as in claim 11 where the angle of recline can be locked by a lock which interacts with said reclining lever.

13. An exerciser as in claim 9 wherein said chair is adjustable as to height.

* * * * *